United States Patent [19]

Brower, Jr. et al.

[11] 4,119,522

[45] Oct. 10, 1978

[54] NOZZLE APPARATUS FOR ELECTROPHORETIC COATING OF INTERIOR SURFACES

[75] Inventors: Loyd R. Brower, Jr., Olympia Fields; Leonard P. Madsen, St. Anne; Chesley L. Zutaut, Park Forest, all of Ill.

[73] Assignee: Standard T Chemical Company, Inc., Chicago, Ill.

[21] Appl. No.: 878,683

[22] Filed: Feb. 17, 1978

Related U.S. Application Data

[63] Continuation-in-part of Ser. No. 807,965, Jun. 20, 1977, which is a continuation of Ser. No. 686,110, Jun. 7, 1976, abandoned, which is a continuation-in-part of Ser. No. 597,314, Jul. 21, 1975, abandoned.

[51] Int. Cl.[2] ..... B01D 13/02; C25D 13/00

[52] U.S. Cl. ..... 204/300 EC

[58] Field of Search ..... 204/300 EC

[56] References Cited

U.S. PATENT DOCUMENTS

| | | | |
|---|---|---|---|
| 3,922,213 | 11/1975 | Smith et al. | 204/181 R |
| 3,997,418 | 12/1976 | Buse et al. | 204/181 R |

*Primary Examiner*—Howard S. Williams

*Attorney, Agent, or Firm*—Carpenter & Ostis

[57] ABSTRACT

An improved nozzle for electrophoretically coating the interior surface of a workpiece, such nozzle having an electrically conductive linear portion corresponding to a selected linear dimension of the workpiece, an electrically conductive head portion connected and disposed substantially normal thereto and corresponding to a closed bottom end of the workpiece, inlet tubing connected to a discharge orifice in the head portion of the nozzle for delivery of electrophoretic material onto the interior surface of the workpiece, and wherein associated means are provided for moving the workpiece and the nozzle relative to one another about an axis fixed relative to the workpiece and the nozzle and in a direction lateral to the selected linear dimension of the workpiece.

9 Claims, 6 Drawing Figures

NOZZLE APPARATUS FOR ELECTROPHORETIC COATING OF INTERIOR SURFACES

BACKGROUND OF THE INVENTION

This application is a continuation-in-part of the co-pending application Ser. No. 807,965, filed on June 20, 1977; which is a continuation of abandoned application Ser. No. 686,110, filed on June 7, 1976; which was in turn a continuation-in-part of application Ser. No. 597,314, filed on July 21, 1975, abandoned.

The application relates generally to electrophoretic coating and more particularly to an improved nozzle apparatus for coating the interior surface of a workpiece, such improved nozzle especially adaptable for mounting a plurality thereof on a high speed coating line, such as those for example shown in the co-pending parent patent application.

Electrophoresis generally concerns the movement of ionic particles within an aqueous system in response to electrical charges imparted to such system. Negatively charged particles or ions in such an aqueous solution (i.e., an anodic coating) migrate in response to an electrical potential to any positively charged conductor which may be immersed in the solution for deposit on the conductor. Positively charged particles or ions (i.e., cathodic coating materials) likewise migrate and are deposited upon a negatively charged conductor within the coating bath.

Typically, an electrical potential in the range of approximately 100 to 500 volts has been used for electrophoretic coating. The thickness, and hence durability, of such an electrophoretically deposited coating layer is dependent upon a number of factors, including, inter alia, the voltage used, the separation between the anode and cathode, the length of time electrophoretic coating is permitted to continue, the pH of the coating solution, the characteristics of the coating polymer used, and the conductivity of the particular material from which the workpiece is constructed. During coating, after some coating particles have been deposited upon the conductive surface of the workpiece, there is a gradual reduction in the conductivity thereof as the workpiece becomes increasingly insulated. When the thickness of the electrophoretically deposited coating layer becomes sufficiently great for a given system, the previously conductive surface becomes insulated to the extent that no further substantial electrodeposition will occur. Similarly, if some portion of the surface of the workpiece has been previously coated with an insulating coating, further electrodeposition on that coated surface will occur only with higher voltages, closer proximity of electrodes, more conductive coating materials, longer coating time, or other changes to the system.

Several disadvantages of prior art devices are set forth with particularity in the co-pending parent application, Ser. No. 807,965, filed on June 20, 1977. Use of the method and apparatus disclosed and claimed therein has materially alleviated the disadvantages of such prior art devices. However, further improvements in nozzle apparatus for electrophoretically coating the interior surface of a workpiece will result in yet additional advantages over the prior art.

Accordingly, it is an object of the present invention to provide an improved nozzle apparatus for electrophoretically coating the interior surface of an electrically conductive workpiece.

Additional objects, advantages and improvements of the nozzle apparatus of the present invention will become apparent to those skilled in the art upon review of the following specification setting forth the preferred embodiments of the present invention.

SUMMARY OF THE INVENTION

The improved nozzle apparatus of the present invention comprises a nozzle for electrophoretically coating the interior surface of an electrically conductive workpiece having a selected linear dimension and a closed bottom substantially normal to the selected linear dimension. The improved nozzle of the present invention includes a linear portion along its longitudinal dimension and a head portion disposed substantially normal thereto at the distal end of the linear portion. The head portion includes a discharge orifice therein for discharging electrophoretic material onto the workpiece interior surface. An inlet tube is connected to the head portion at the discharge orifice for supplying the electrophoretic material under pressure from an electrophoretic supply means, such as a pump, to the discharge orifice. The head portion is constructed of electrically conductive material and shaped such that, when the nozzle is mounted in the interior of the workpiece, the head portion is disposed in closely spaced proximity to the bottom of the workpiece. The linear portion of the nozzle is likewise constructed of an electrically conductive material and is disposed in closely spaced proximity coextensively with the selected linear dimension of the workpiece when the nozzle is mounted in the interior of the workpiece for electrophoretic coating. The linear portion of the nozzle is preferably formed in cross-section to conform substantially to the contour of the interior surface of the workpiece.

The improved nozzle apparatus of the present invention is disposed within the interior of the workpiece, such that, when electrophoretic material flows from the orifice of the nozzle, a linear stream of electrophoretic material is established between the linear dimension of the workpiece and the linear portion of the nozzle, and also between a radius of the bottom of the workpiece and the head portion of the nozzle. Upon imparting opposite electrical charges to the nozzle and the workpiece, electrophoretic migration of the electrophoretic material occurs from the nozzle head portion and linear portion onto the proximately disposed workpiece surface. Relative motion between the workpiece and the nozzle is provided about an axis fixed relative to the workpiece and the nozzle and in a direction lateral to the selected linear dimension of the workpiece to pass electrophoretic material over the entire interior surface of the workpiece for electrophoretic coating thereof.

The workpiece bottom may have a contoured surface, such as for example the radially disposed bead or the dome of the bottom of an extruded one-piece aluminum can. In applications where the workpiece has a contoured bottom, the head portion of the nozzle includes contours substantially conforming to those of the contoured bottom surface, which contours on the nozzle head portion may preferably comprise projections or tines, for conforming substantially to the contours of the workpiece bottom surface.

In an alternative embodiment, the improved nozzle of the present invention may include insulators disposed longitudinally along the nozzle and extending laterally of the linear portion of nozzle for allowing the linear stream flowing along the selected linear dimension of the workpiece to contact only the linear portion of the nozzle, thereby to prevent nozzle portions other than the linear portion or the head portion from effecting extraneous electrophoretic migration and deposition of electrophoretic material. Such insulators thereby promote uniformity of coating of the entire interior surface.

A mesh screen, preferably of electrically conductive material, may be disposed across the discharge orifice of the nozzle to promote laminar flow, to materially reduce turbulence in the electrophoretic material as it flows from the nozzle to the workpiece interior surface, and to form a conductive surface substantially co-extensive with the surface of the head portion of the nozzle when such surface is disposed in close proximity to the bottom of the workpiece.

The improved nozzle apparatus of the present invention may further include means for providing an adjustable longitudinal angle between the selected linear diemsnion of the workpiece and the linear portion of the nozzle to dispose the nozzle and the workpiece in longitudinally canted relationship. When the nozzle and the adjacent workpiece interior surface are disposed in longitudinally canted relationship, they are then separated by vertical distance *d*, the linear portion of the nozzle having a variable transverse width *w*, and wherein *d* times *w* equals substantially a constant, thereby to provide substantially equal electrical flux between the nozzle and the workpiece interior surface for deposition of coating material to a uniform thickness along the selected linear dimension of the workpiece and over the entire interior workpiece surface.

DETAILED DESCRIPTION OF THE PREFERRED EMBODIMENTS

Figure 1:
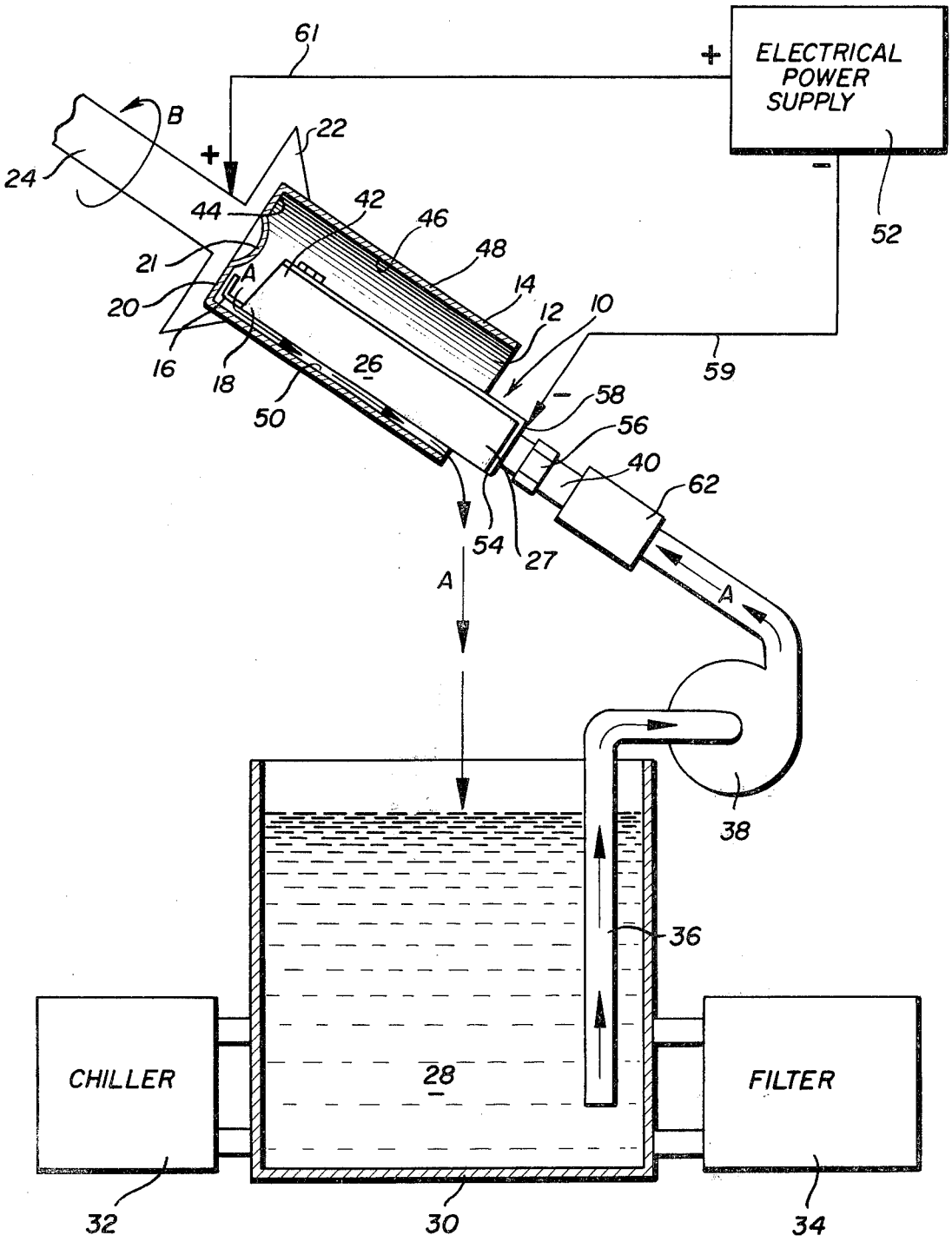
FIG. 1 is a schematic side view of one preferred embodiment of the imporved nozzle apparatus of the present invention, shown disposed within a workpiece having a domed bottom, for applying electrophoretic material from a reservoir to the workpiece interior surface (See arrows A), the workpiece being held by a workpiece holder which is mounted on a mandrel for providing relative rotational movement between the workpiece and the nozzle (See arrow B), the nozzle and the workpiece being oppositely electrically charged from the power supply.
Figure 2:
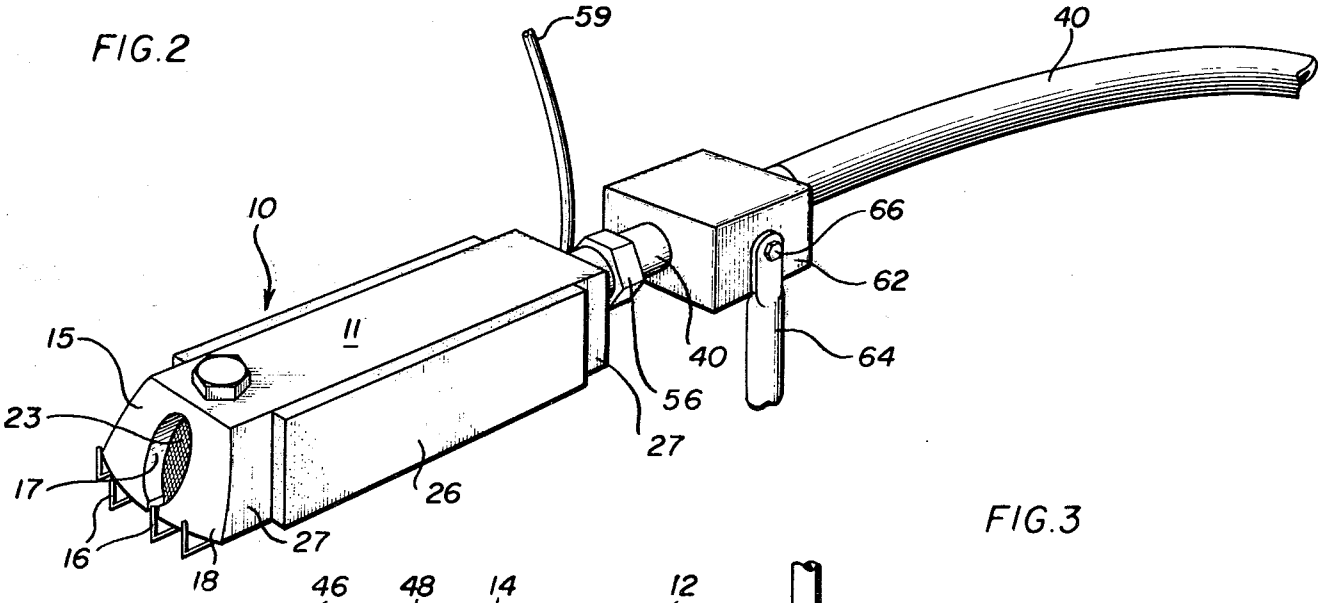
FIG. 2 is a perspective view of the preferred embodiment of the improved nozzle apparatus of the present invention as shown in FIG. 1, showing insulative means disposed longitudinally along the nozzle and extending laterally of the linear portion of the nozzle, and further showing an alternative discharge orifice structure including a notch at the lower portion thereof, an alternative tine structure for uniformity of electrophoretic coating of a workpiece having a domed bottom.
Figure 3:
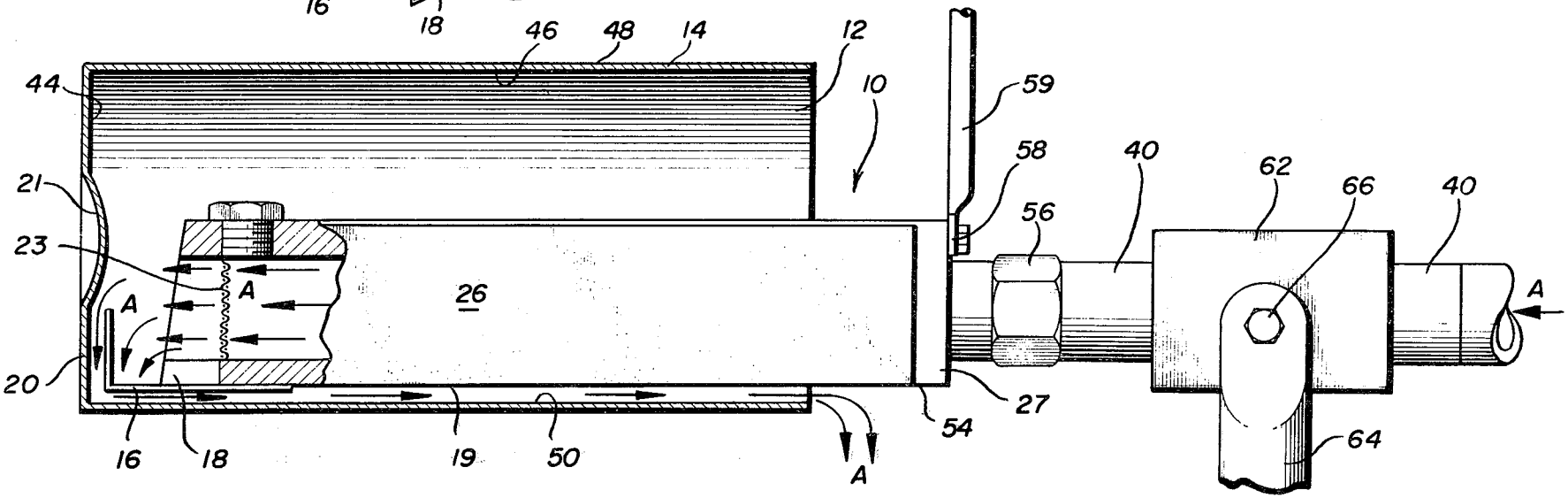
FIG. 3 is an enlarged cross-sectional view of the preferred embodiment of the improved nozzle apparatus of FIGS. 1 and 2, partially cut away to show the flow of electrophoretic material through the electrophoretic material tube, through the length of the nozzle, through the mesh grid, onto the bottom of the workpiece, along the linear dimension thereof, and flowing from the open end of the workpiece (See arrows A)

Referring now to the drawing, to FIG. 1 in particular, and also to FIGS. 2 and 3, the improved nozzle apparatus of the present invention, shown generally at 10, is inserted into the open end 12 of a workpiece 14. Nozzle 10 includes electrically conductive tines 16 projecting from the radial surface 18 thereof adjacent the workpiece bottom 20 which conform to the contours of closed end or bottom 20 of workpiece 14. In the particular embodiment of FIG. 1, workpiece 14 is of the type having a domed shaped bottom portion 21. Workpiece 14 is mounted on a workpiece holder 22, which is in turn supported by a mandrel 24 for rotational movement (See arrow B). Alternatively in other preferred embodiments, nozzle 10 may itself by mounted for rotation.

In the embodiment shown in FIG. 1, nozzle 10 includes insulators 26 disposed longitudinally along the length of nozzle 10 and extending laterally on nozzle 10 to shield side portions 27 of nozzle 10 from exerting any extraneous electrophoretic migrational effect. Electrophoretic material 28 is supplied to nozzle 10 from a reservoir 30, including preferably a chiller 32 and a filter 34, by means of a snorkle 36 driven by a pump 38. Electrophoretic material 28 is then pumped through an electrophoretic material supply tube 40 to nozzle 10, where it flows from distal end 42 of nozzle 10 into workpiece 14, onto the bottom interior surface 44, and then onto the interior surface 46 of workpiece body 48 at linear dimension 50 thereof (See arrows A). Such electrophoretic material 28 then flows from open end 12 of workpiece 14 for return of the excess thereof to reservoir 30. Nozzle 10 and workpiece 14 are oppositely electrically charged by means of an electrical power supply 52 shown connected to nozzle 10 near the proximal end 54 thereof and to mandrel 34 respectively.

Referring now to FIGS. 2 and 3 which also depict in an enlarged view the preferred embodiment of the improved nozzle apparatus of the present invention as shown generally in FIG. 1, nozzle 10 may preferably be constructed of a solid nozzle body 11 of electrically conductive material having disposed longitudinally and laterally of side portions 27 thereof insulators 26 to allow the stream of electrophoretic material 28 flowing from the discharge orifice 17 thereof to contact only the linear portion 18 of nozzle 10 which is disposed along linear dimension 50 of workpiece 14. Linear portion 19 is shaped in cross-section to conform substantially to the contours of workpiece body 48. Nozzle body 11 includes a face portion 15 for disposition adjacent to the closed bottom 20 of workpiece 14 when mounted for electrophoretic coating. Adjacent thereto and in closely spaced proximity, discharge orifice 17 is provided in face portion 15 for discharging the electrophoretic material 28 from nozzle 10 onto bottom interior surface 44 of workpiece 14. A mesh screen 23 is disposed over discharge orifice 17 for promoting laminar flow. Mesh screen 23 should be constructed of electrically conductive material to avoid any discontinuance of the electrical field along face portion 15 of nozzle 10. Preferably electrically conductive tines 16 project from the radial surface 18 of face portion 15 for disposition in closely spaced proximity to the contours of interior surface 44 of workpiece 14 for uniformity of the electrophoretic coating.

Nozzle 10 further includes a coupling member 56 at proximal end 54 thereof for changing nozzles, and an electrical terminal 58 near such proximal end 54 for charging nozzle 10 to one electrical potential through wire 59. Workpiece 14 is oppositely charged through wire 61 for establishing an electrophoretic path therebetween. Nozzle 10 is supported by an adjustable nozzle holder 62 having an arm 64 pivotably connected thereto at bolt 66 for varying the angle of cant of nozzle 10 with respect to the longitudinal axis of workpiece 14.

In the embodiment shown in FIGS. 2 and 3, electrophoretic material 28 is pumped through the electrophoretic material tube 40, through the length of nozzle 10, through mesh screen 23 for discharge at discharge orifice 17 thereof onto a radius of bottom interior surface 44. Whereupon, electrophoretic material 28 flows from such radius of bottom interior surface 44 of workpiece 14 onto interior surface 46 of workpiece body 49 along selected linear dimension 50 thereof. During such flow along selected linear dimension 50 of the workpiece body 48, electrophoretic material 28 is in contact with both linear portion 19 of nozzle 10 and selected linear dimension 50 of workpiece body 48. Side disposed insulators 26 serve to permit contact by electrophoretic material 28 only along linear portion 19 of nozzle 10, thereby to prevent other nozzle portions from exerting an extraneous electrophoretic effect.

Figure 4:
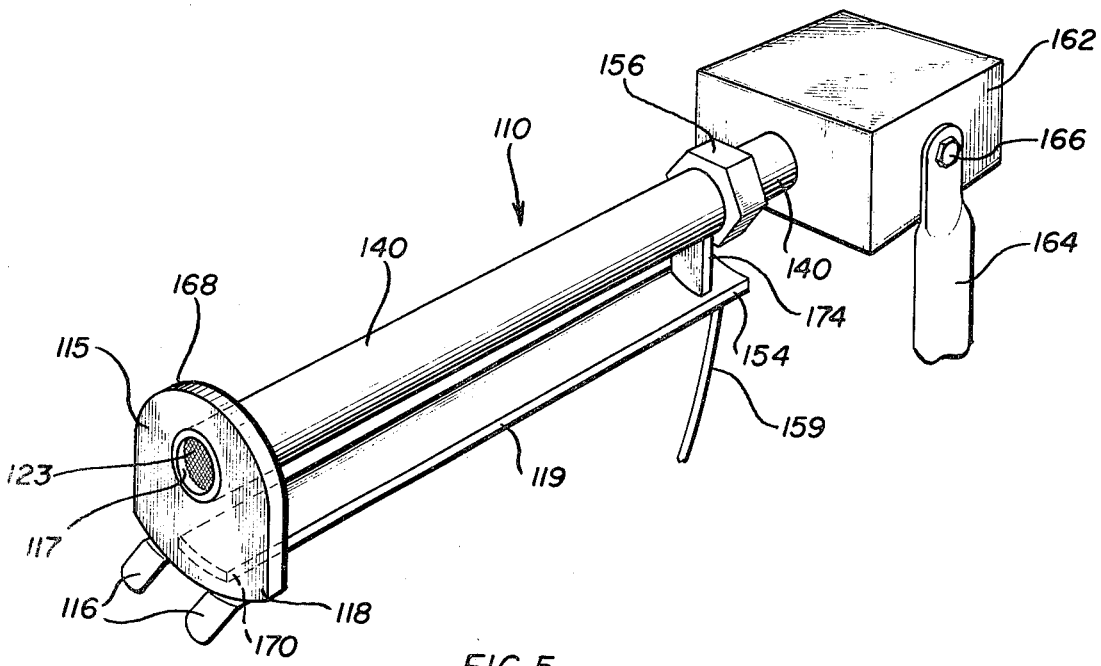
FIG. 4 is a perspective view of a second embodiment of the improved nozzle apparatus of the present invention, including a nozzle linear portion; a head portion of the nozzle disposed substantially normal thereof at the distal end of the nozzle, having a mesh grid covering the electrophoretic material discharge orifice therein, and including tines extending from a radial portion thereof; an electrophoretic material tube for supplying electrophoretic material to the discharge orifice; a nozzle brace disposed near the proximal end of the nozzle; a coupling for changing nozzles; an electrical terminal for connection to an electrical power supply; and a nozzle holder having means for adjusting the angle thereof.
Figure 5:
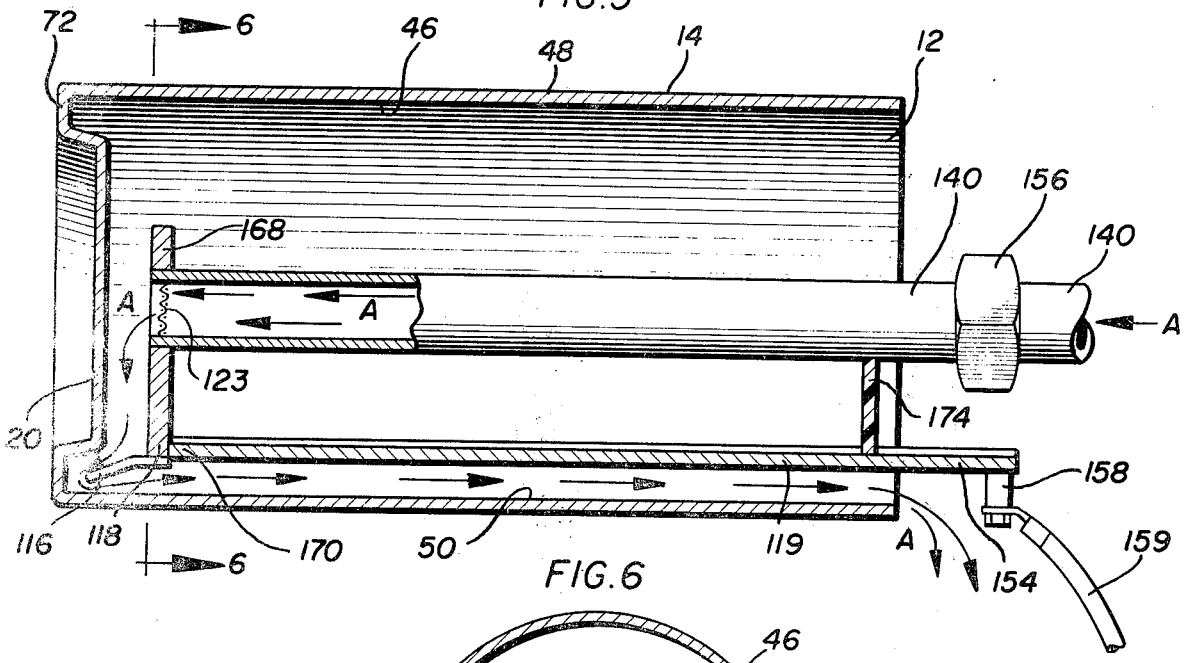
FIG. 5 is a cross-sectional side view of the preferred embodiment of the improved nozzle apparatus of FIG. 4 shown disposed within a workpiece having a radially beaded bottom, and further shows at arrows A the flow path of electrophoretic material through the electrophoretic material tube, to the discharge orifice, through the mesh grid, onto the tines for flow around the radial beaded contours of the workpiece bottom, along the linear dimension of the workpiece body portion and out the open end of the workpiece.
Figure 6:
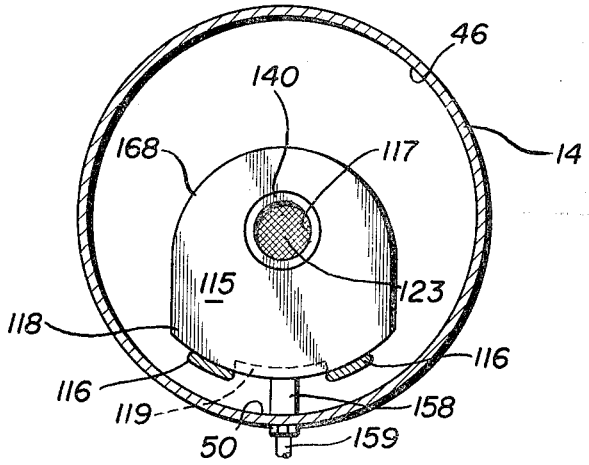
FIG. 6 is a sectional end view taken along line 6—6 of FIG. 5 which shows, disposed within a workpiece, the head portion of the preferred embodiment of improved nozzle apparatus of the present invention as shown in FIGS. 4 and 5, supra, and further shows the tines disposed radially from the periphery of the head portion, the mesh grid disposed in the discharge orifice thereof, and the electrical terminal for establishing an electrical connection between the nozzle and the electrical power supply.

Referring now to FIGS. 4–6 wherein a second preferred embodiment of the improved nozzle apparatus of the present invention is shown, nozzle 110 comprises a linear portion 119 disposed along the length of nozzle 110 and corresponding to selected linear dimension 50 of workpiece body 48, as shown particularly in FIG. 5. A head portion 168 of nozzle 110 is connected to linear portion 119 and is disposed substantially normal thereto at distal end 170 of linear portion 119 of nozzle 110. Head portion 168 includes a face 115 having a orifice 117 therein for discharge of electrophoretic material 28. Discharge orifice 117 is preferably covered by mesh screen 123 to promote laminar flow. Linear portion 119, head portion 168 and mesh screen 123 covering discharge orifice 117 are all constructed of an electrically conductive material. Electrically conductive tines 115 project from radial portion 118 of head portion 168 for directing electrophoretic material into the beaded radial portion 72 of workpiece bottom 20, as shown particularly in FIG. 5.

Nozzle 110 of FIGS. 4–6 includes electrophoretic material supply tube 140 constructed of an electrically insulative material, and further includes a coupling member 156 for changing nozzles. As in the embodiment of FIGS. 1–3, an adjustable nozzle holder 162 having an arm 164 pivotably connected thereto at bolt 166 may be provided. A preferably electrically insulative support bar 174 is attached between linear portion 119 and electrophoretic material supply tube 140 to provide structural support and stability to proximal end 154 of nozzle 110. Nozzle linear portion 119 is electrically charged by means of an electrical terminal 158 through wire 159 disposed at proximal end 54 of linear portion 19. Workpiece 14 is oppositely electrically charged preferably by applying an electrical charge to the workpiece holder, as shown in FIG. 1.

Electrophoretic material 28 is supplied to electrophoretic material supply tube 140 and flows longitudinally through nozzle 110 and through mesh screen 123 to impinge upon bottom surface 44, flows along the radius thereof, and into the radial beaded portion 22 of workpiece bottom 20 aided by tines 116. Whereupon, electrophoretic material 28 further flows along linear dimension 50 of workpiece 14 while in contact with both linear portion 119 of nozzle 110 and linear dimension 50 of workpiece body 48. The opposite charges between nozzle 110 and workpiece 14 establish an electrophoretic path therebetween for electrodeposition of electrophoretic material 28 onto workpiece interior bottom surface 44 and onto body interior surface 46 to form a coating thereon. During such flow of electrophoretic material 28, workpiece 14 and nozzle 110 are moved relative to one another about an axis fixed relative to workpiece 14 and nozzle 110 in a direction lateral to selected linear dimension 50 of workpiece 14. Preferably such relative motion constitutes relative rotational movement between workpiece 14 and nozzle 110, and such relative rotational movement may be accomplished by rotating either of workpiece 14 or nozzle 110.

The workpiece may in general be of any size or shape as long as the nozzle may be disposed in close proximity thereto. However, the improved nozzle apparatus of the present invention has been particularly suitable for use in connection with workpieces which are steel or aluminum beverage cans, having a beaded or domed closed bottom end. The materials used for the electrically conductive portions of the nozzle, such as the head portion, linear portion, tines, mesh screen and nozzle electrical terminal may in general be formed from any metal, although aluminum and stainless steel have been particularly suitable. Electrically insulative nozzle portions, such as the material tube, the nozzle support brace and the side disposed nozzle insulators may be formed for example from a plastic material, such as polyethylene.

The basic and novel characteristics of the improved nozzle apparatus of the present invention and the advantages thereof will be readily understood by those skilled in the art from the foregoing disclosure. It will become readily apparent that various changes and modifications may be made in the form, construction and arrangement of the improved nozzle apparatus set forth hereinabove without departing from the spirit and scope of the invention. Accordingly, the preferred and alternative embodiments of the present invention set forth hereinabove are not intended to limit such spirit and scope in any way.

What is claimed is:

1. In an apparatus for electrophoretically coating the interior surface of an electrically conductive workpiece having a selected linear dimension and a bottom substantially normal to the selected linear dimension, which apparatus includes: a nozzle of electrically conductive material having a selected linear dimension corresponding to that of the workpiece; means for mounting the nozzle in the workpiece in closely spaced proximity to the interior surface thereof and along the selected linear dimension thereof; a reservoir for containing a liquid electrophoretic material; means for supplying electrophoretic material under pressure to the nozzle; an electrical circuit connected between the nozzle and the workpiece for establishing an electrophoretic path therebetween; and means for moving the workpiece and the nozzle relative to one another about an axis fixed relative to the workpiece and the nozzle and in a direction lateral to the selected linear dimension of the workpiece, the improvement comprising:

a nozzle having a linear portion along its linear dimension, a head portion connected to the linear portion and disposed substantially normal thereto at one end of the linear portion and including a discharge orifice therein, and inlet tubing connected to the head portion at the discharge orifice thereof for supplying electrophoretic material from the electrophoretic supply means to the discharge orifice, the head portion being of electrically conductive material and shaped whereby when the nozzle is mounted in the workpiece the head portion is disposed in closely spaced proximity to the bottom of the workpiece, the linear portion being of electrically conductive material and coextensive with the selected linear dimension of the workpiece, the linear portion being closely spaced from the interior surface of the workpiece when the nozzle is mounted in the workpiece, and the linear portion being formed in cross-section to conform substantially to the contour of the interior surface of the workpiece, whereby when electrophoretic material is applied to the workpiece through the discharge orifice in said nozzle a linear stream of electrophoretic material is established between the linear dimension of the workpiece and the linear portion of said nozzle, and between a radius of the bottom of the workpiece and the head portion of the nozzle, for electrophoretic migration of the electrophoretic material onto the workpiece surface, and whereby the linear stream of electrophoretic material is passed over the entire interior surface of the workpiece by the relative motion between the workpiece and said nozzle, thereby to deposit electrophoretically a coating of the electrophoretic material over the entire interior surface.

2. The improvement of claim 1 wherein the workpiece bottom has a contoured surface and the head portion of said nozzle includes contours substantially conforming to those of the bottom surface.

3. The improvement of claim 1 wherein the bottom has a contoured surface and further comprising electrically conductive projection means carried by the head portion of said nozzle for extending substantially into the contours of the bottom surface.

4. The improvement of claim 3 wherein the workpiece is a cylindrical container having an open end oppositely disposed from the bottom thereof and having a circumferential beaded bottom portion, which beaded bottom portion is convex relative to the open end of the container, and wherein the projection means carried by said nozzle extend substantially into the beaded bottom portion of the container.

5. The improvement of claim 1 further comprising insulative means disposed longitudinally along said nozzle and extending laterally of the linear portion of said nozzle for allowing the linear stream flowing along the selected linear dimension of the workpiece to contact only the linear portion of said nozzle, thereby to prevent nozzle portions other than the linear portion and the head portion from effecting extraneous electrophoretic migration and electrodeposition of material, whereby uniformity of coating over the entire interior surface is enhanced.

6. The improvement of claim 1 further comprising mesh screen covering means disposed across the discharge orifice of said nozzle for materially reducing turbulence in the electrophoretic coating material flowing from said nozzle onto the workpiece interior surface.

7. The improvement of claim 6 wherein said mesh screen covering means comprises electrically conductive grid means for forming a conductive surface substantially coextensive with the surface of the head portion of said nozzle when such surface is disposed in close proximity to the bottom of the workpiece.

8. The improvement of claim 1 further comprising means for providing an adjustable longitudinal angle between the selected linear dimension of the workpiece and the linear portion of said nozzle to dispose said nozzle and the workpiece in longitudinally canted relationship.

9. The improvement of claim 8 wherein said nozzle and the adjacent workpiece interior surface are disposed in longitudinally canted relationship and are separated by a variable distance $d$, and the linear portion of said nozzle has a variable transverse width $w$, and wherein $d$ and $w$ are varied to provide substantially equal electrical current density between said nozzle linear portion and the workpiece interior surface for electrodeposition of coating material to a uniform thickness along the selected linear dimension of the workpiece and over the entire interior workpiece surface.

* * * * *